US012588716B2

(12) United States Patent
Anderson

(10) Patent No.: US 12,588,716 B2
(45) Date of Patent: Mar. 31, 2026

(54) ARM-MOUNTED BREASTFEEDING COVER

(71) Applicant: Katherine Elaine Anderson, Longmont, CO (US)

(72) Inventor: Katherine Elaine Anderson, Longmont, CO (US)

( * ) Notice: Subject to any disclaimer, the term of this patent is extended or adjusted under 35 U.S.C. 154(b) by 282 days.

(21) Appl. No.: 18/136,801

(22) Filed: Apr. 19, 2023

(65) Prior Publication Data

US 2023/0329363 A1 Oct. 19, 2023

Related U.S. Application Data

(60) Provisional application No. 63/363,211, filed on Apr. 19, 2022.

(51) Int. Cl.

| | |
|---|---|
| ***A41D 1/215*** | (2018.01) |
| ***A45B 11/02*** | (2006.01) |
| *A45B 15/00* | (2006.01) |

(52) U.S. Cl.

CPC ..... *A41D 1/215* (2018.01); *A45B 11/02* (2013.01); *A45B 15/00* (2013.01)

(58) Field of Classification Search

CPC ..... A41D 1/215; A42B 1/201; A45B 11/02; A45B 15/00; A45B 2023/0006; A45B 23/00; A45F 2003/006; A45F 2005/008

USPC ..... 224/187, 222, 267

See application file for complete search history.

(56) References Cited

U.S. PATENT DOCUMENTS 4,836,232 A * 6/1989 De Rosa ..... A45B 19/04 135/147
5,355,902 A * 10/1994 Schlangen ..... A45B 11/00 135/22
D359,161 S * 6/1995 Byrne ..... D3/5
8,333,358 B2 * 12/2012 Carnes ..... A01K 97/10 43/25
9,480,326 B2 * 11/2016 Stephens ..... A45F 5/00
2009/0044825 A1 * 2/2009 Lawrence ..... A45D 33/006 206/581

FOREIGN PATENT DOCUMENTS

KR 20090004298 A * 1/2009 ..... A42B 1/18

OTHER PUBLICATIONS

KR-20090004298-A Translation, Suh Deok Yong, Jan. 12, 2009 (Year: 2009).*

* cited by examiner

*Primary Examiner* — Nathan J Newhouse
*Assistant Examiner* — Matthew T Theis
(74) *Attorney, Agent, or Firm* — Cozen O'Connor

(57) ABSTRACT

A breastfeeding screen may include a foldable screen having: at least three radial arms, each radial arm having a first aperture formed at a first end, a support structure comprising (a) two orthogonal lugs having aligned second apertures, a first pivot pin passing between the aligned second apertures and through each of the first apertures of the at least three radial arms to allow the at least three radial arms to rotate around the first pivot pin; and a material coupled to the at least three radial arms that, when the at least three radial arms rotate bout the first pivot pin, spans between the at least three radial arms. A Breastfeeding screen may include a releasable mounting mechanism being fixedly attached to the support structure adapted to attach the breastfeeding screen to an object.

17 Claims, 14 Drawing Sheets

100

ARM-MOUNTED BREASTFEEDING COVER

CROSS-REFERENCE TO RELATED APPLICATIONS

This application claims priority to, and benefits from, U.S. Provisional Application Ser. No. 63/363,211, filed Apr. 19, 2022, and entitled Arm-Mounted Breastfeeding Cover. The entirety of the aforementioned application is incorporated by reference.

BACKGROUND

Breastfeeding covers on the market are annoying, stressful, and difficult to use. The shawl-like breastfeeding covers are hard to put on and tend to fall off easily. The material of the breastfeeding cover drapes over both the mother and the baby, making it hard for the mother to see the baby without dislodging the breastfeeding cover. The material of the breastfeeding cover causes discomfort where it contacts the mother and/or the baby and is heated by the sun. These shawl-like breastfeeding covers are not secured, and fall off easily, particularly when the mother or the baby moves, and/or because of unexpected air drafts.

SUMMARY

One aspect of the present embodiments includes the realization that a breastfeeding mother uses one arm to hold the baby, leaving only one arm free to drape and position a loose breastfeeding cover. Where the breastfeeding cover is a simple shawl-like material, a portion of the material must be thrown over the mother's shoulder and is retained only by friction between the material and the shoulder. The breastfeeding cover is therefore difficult to don and falls off easily. The present embodiments solve this problem using an arm-mounted breastfeeding screen that attaches to the arm of the mother and is easily pulled-up for feeding and put down when done. Advantageously, the arm-mounted breastfeeding screen easily attaches to the arm, near the wrist for example, and is very easily deployed and positioned by the mother's other arm. A further advantage is that the easily positioned arm-mounted breastfeeding screen can be used as a sunshade when holding the baby outside.

Another aspect of the present embodiments includes the realization that shade and/or privacy is needed in other situations. The present embodiments solve this problem by allowing a screen portion of the arm-mounted breastfeeding screen to separate from an arm-mounting base and attach to any one of a plurality of additional bases that are each shaped and sized to attach to equipment associated with the baby, such as to strollers, car seats, and so on.

BRIEF DESCRIPTION OF THE FIGURES

FIG. 3 shows the plate of the foldable screen of FIGS. 1 and 2 in further example detail.

DETAILED DESCRIPTION OF THE EMBODIMENTS

Figure 1:
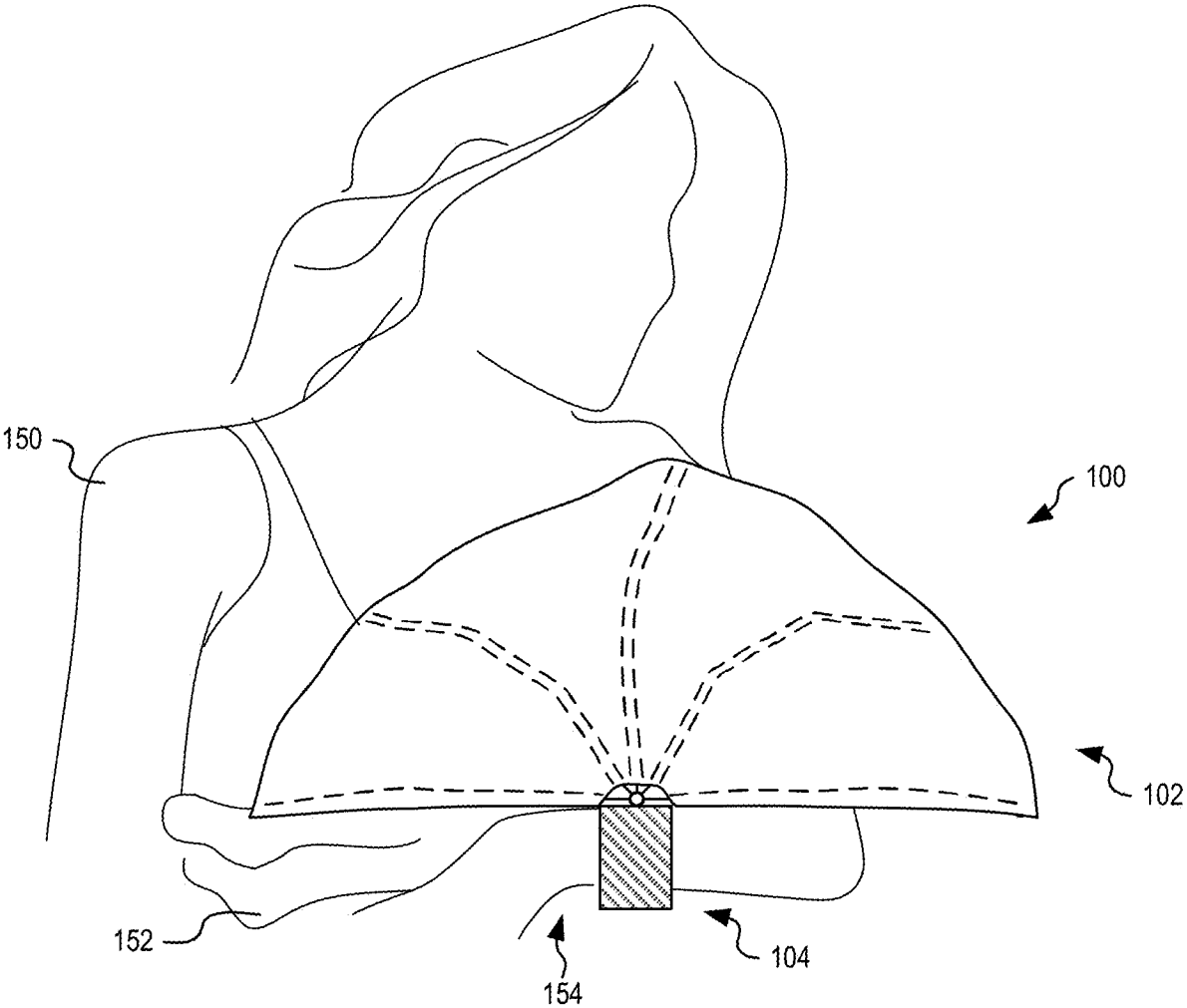
FIG. 1 shows one example breastfeeding screen being used by a mother breastfeeding a baby, in an embodiment.

FIG. 1 shows one example breastfeeding screen 100 being used by a mother 150 breastfeeding a baby 152. Breastfeeding screen 100 has a foldable screen 102 and an adjustable base 104 that releasably attaches to a forearm 154 (or wrist) of mother 150 to support foldable screen 102 and provide privacy while breastfeeding baby 152. In the shown embodiment, adjustable base 104 includes an elasticated cuff sized to comfortably attach to forearm 154 such that it does not easily move. However, in at least some embodiments, adjustable base 104 is detachable from foldable screen 102 to allow foldable screen 102 to use other types of adjustable base. For example, other forms of adjustable base 104 allow foldable screen 102 to attach to other objects, as described in further detail below.

Once adjustable base 104 is attached to forearm 154, foldable screen 102 may be positioned and adjusted by a free hand of mother 150 and does not inadvertently detach or fall from forearm 154. More particularly, foldable screen 102 retains its position, relative to adjustable base 104, and does not require continual repositioning, unlike prior art breastfeeding covers that slip and fall off inadvertently. Further, in at least some embodiments, foldable screen 102 may be folded up (e.g., swept to either side of adjustable base 104 to lie flat along forearm 154) when no longer required, and retains its folded configuration until redeployed. That is, when no longer required, foldable screen 102 may be folded-up out In some aspects, the techniques described herein relate to a breastfeeding screen, including: a foldable screen having: at least three radial arms, each radial arm having a first aperture formed at a first end; a support structure including (a) two orthogonal lugs having aligned second apertures; a first pivot pin passing between the aligned second apertures and through each of the first apertures of the at least three radial arms to allow the at least three radial arms to rotate around the first pivot pin; and a material coupled to the at least three radial arms that, when the at least three radial arms rotate bout the first pivot pin, spans between the at least three radial arms; a releasable mounting mechanism being fixedly attached to the support structure adapted to attach the breastfeeding screen to an object.

In some aspects, the techniques described herein relate to a breastfeeding screen, the support structure further including: a first part having the two orthogonal lugs on a first side of the first part and a first coupling structure extending from a second side of the first part; a second part with a second coupling structure, formed on a first side of the second part and that is sized and shaped to removably couple with the first coupling structure.

In some aspects, the techniques described herein relate to a breastfeeding screen, one of the first coupling structure and the second coupling structure being a dovetailed groove and the other of the first coupling structure and the second coupling structure being a dovetailed tongue, wherein the dovetailed tongue slides into the dovetail groove and is retained therein by friction therebetween.

In some aspects, the techniques described herein relate to a breastfeeding screen, the first part being rotatable with respect to the second part.

In some aspects, the techniques described herein relate to a breastfeeding screen, the first part and the second part coupled together via a magnet.

In some aspects, the techniques described herein relate to a breastfeeding screen, each of the at least three radial arms being formed of a single segment.

In some aspects, the techniques described herein relate to a breastfeeding screen, the single segment being flexible.

In some aspects, the techniques described herein relate to a breastfeeding screen, each of the at least three radial arms being formed of at least two segments coupled together by respective arm pivot pin to form a respective articulation at the location of the arm pivot pin.

In some aspects, the techniques described herein relate to a breastfeeding screen, each articulation being indexed by opposing teeth formed around an aperture for receiving the arm pivot pin, wherein the teeth allow articulation of the segments around the arm pivot pin to predefined angles defined by the opposing teeth.

In some aspects, the techniques described herein relate to a breastfeeding screen, the releasable mounting mechanism being a cuff formed of an elasticated band sized to fit around a person's arm.

In some aspects, the techniques described herein relate to a breastfeeding screen, the cuff defining an aperture, wherein the support structure extends through the aperture.

In some aspects, the techniques described herein relate to a breastfeeding screen, the support structure further including a support plate positioned between the cuff and a user's wrist when the breastfeeding screen is in use.

In some aspects, the techniques described herein relate to a breastfeeding screen, the cuff further including a hook-and-loop closure.

In some aspects, the techniques described herein relate to a breastfeeding screen, the cuff being sewn to the second coupling structure.

In some aspects, the techniques described herein relate to a breastfeeding screen, the releasable mounting mechanism being a clamp sized and shaped to attach to one or both of a stroller, and a car seat.

In some aspects, the techniques described herein relate to a breastfeeding screen, the material having a semi-spherical shape forming at least three pockets, each of the three pockets receiving a different one of the three radial arms. 47317036v.2 47317036v.2t of the way of baby 152 while still secured to forearm 154 or may be quickly removed from forearm 154.

Figure 2:
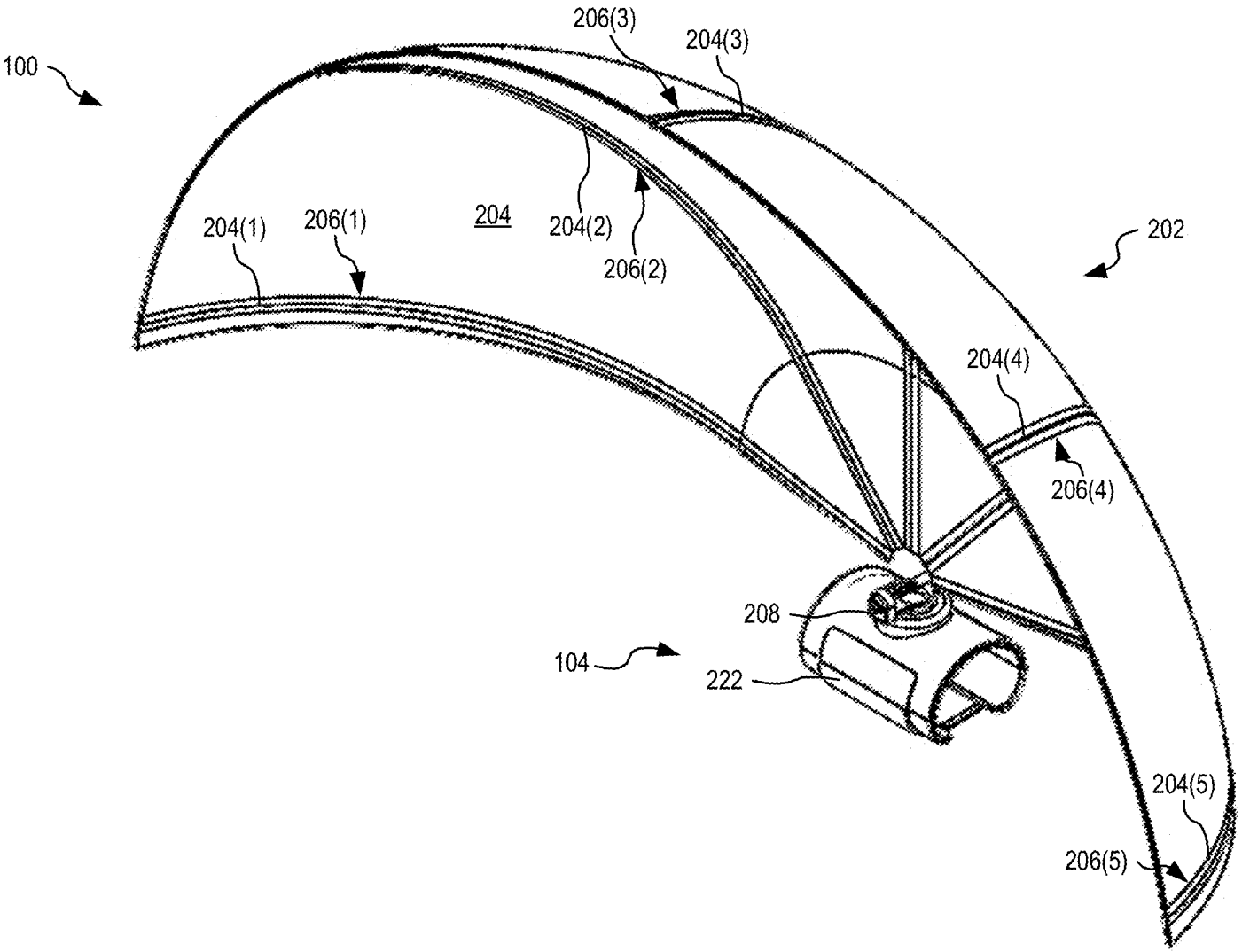
FIG. 2 shows the breastfeeding screen of FIG. 1 in further example detail.

FIG. 2 shows breastfeeding screen 100 of FIG. 1 in further example detail. Foldable screen 102 includes a semicircular shaped material 202 that is supported by a plurality of radial arms 204 positioned within pockets 206 formed radially in material 202 as shown. In the example of FIGS. 1 and 2, foldable screen 102 has five radial arms 204(1)-(5), each pivotably coupled with a plate 208. During testing, five radial arms provided a better shape ("bubble") to material 202 as compared to four radial arms. However, foldable screen 102 may have more or fewer radial arms 204 without departing from the scope hereof.

Material 202 is a non-transparent material such as one or more of a cotton fabric, a nylon fabric, a polyester fabric, and so on, that may be colored and/or patterned on one or both sides. Material 202 may be a single layer, or may have two or more layers fastened (e.g., sewn) together. In certain embodiments, material 202 may include a fastening mechanism (e.g., a buttonhole) that attaches to plate 208 to retain material 202 on radial arms 204. Material 202 may be removed for cleaning (e.g., washing, wiping, etc.). Advantageously, material 202 is breathable, fashionable, machine washable, exchangeable, and is easy to fabricate.

Figure 3:
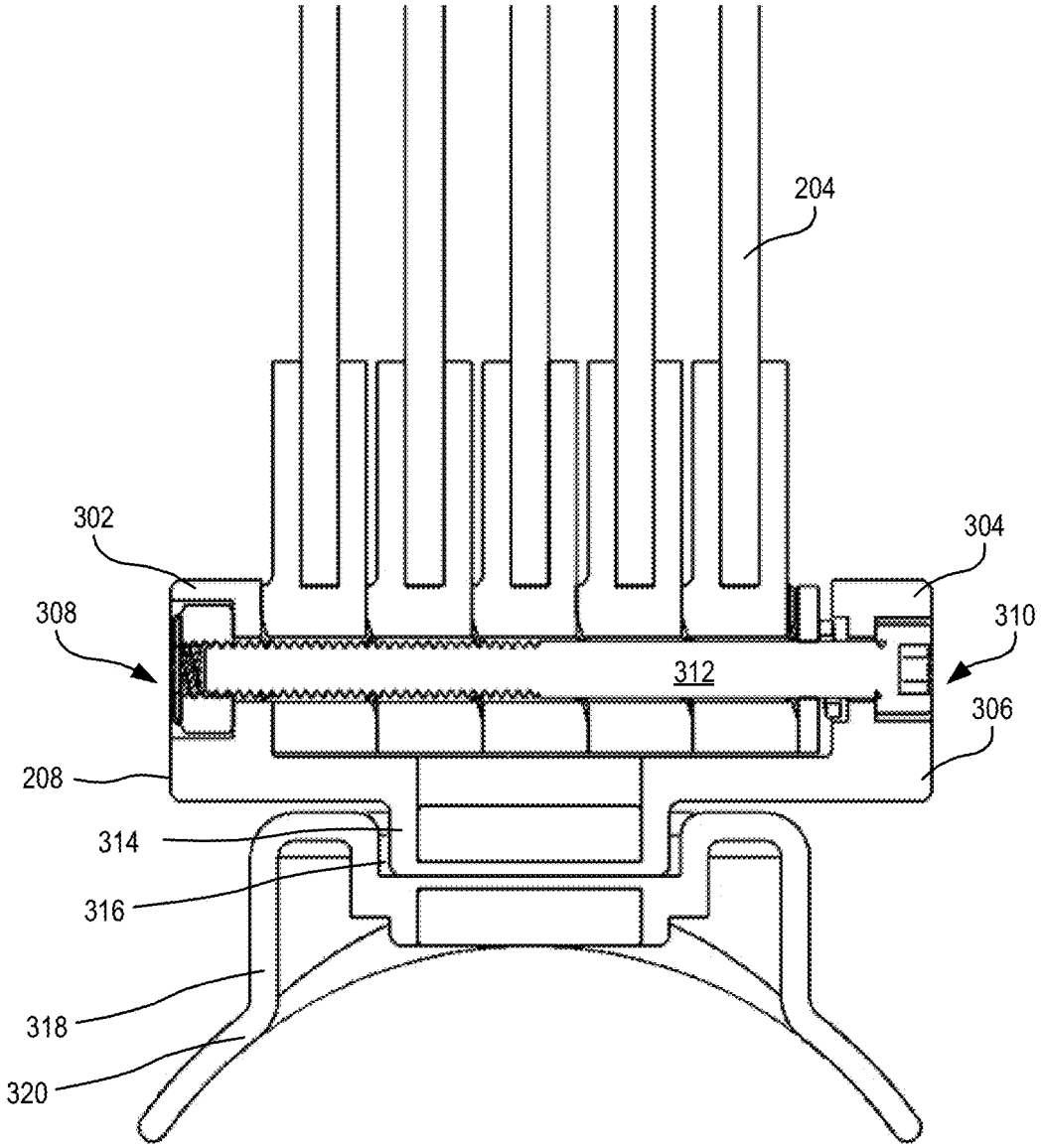
FIG. 3 shows support structure of FIG. 3 in further example detail, in one embodiment.

FIG. 3 shows support structure 208 in further example detail, in one embodiment. Support structure 208 has two opposed lugs 302 and 304, formed orthogonally on a rotating part 306 of support structure 208. Lug 302 forms a first aperture 308 and lug 304 forms a second aperture 310 that is aligned with first aperture 308. A pivot pin 312 (e.g., a bolt or other rod) extends between lugs 302 and 304 to secure arms 204 to the support structure 208 by passing through an aperture on the end of the arms 204 such that the arms 204 may hinge around pivot pin 312. A first coupling structure 314 (which may be a protrusion) is formed on a second side of rotating part 306, opposite the first side to which lugs 302 and 304 extend. First coupling structure 314 couples to a corresponding second coupling structure 316 in a support plate 318. Second coupling structure 316 is sized and shaped to removably couple with the first coupling structure 314. Second coupling structure 316 may include an aperture structure that receives first support structure 314. Second coupling structure 316 may secure the first coupling structure 314 using one or more of a magnet, a clip structure (e.g., a piece of the second coupling structure 316 that interfaces with the first coupling structure 314, or another fastening structure. Support f 318 is coupled to a releasable mounting mechanism 222 is an elasticated (e.g., Lycra® and/or elastic) cuff with a Velcro® (hook-and-loop) closure that is sized to comfortably attach to forearm 154 such that it does not easily move. However, releasable mounting mechanism 222 may take other forms for attaching to other objects as needed. See FIGS. 18 and 19 for example. Support plate 318 may have a base 320 that is curved to fit around a forearm or wrist. Second coupling structure 316 may be raised with respect to base 320 such that the rotation of rotating part 306 does not impact the wearer of the breastfeeding screen 100.

Support structure 208 provides the advantage that the breastfeeding cover material 202, and arms 204 supporting material 204 may be rotated to provide the desired coverage regardless of the position the wearer's arm/wrist is in.

Figure 4:
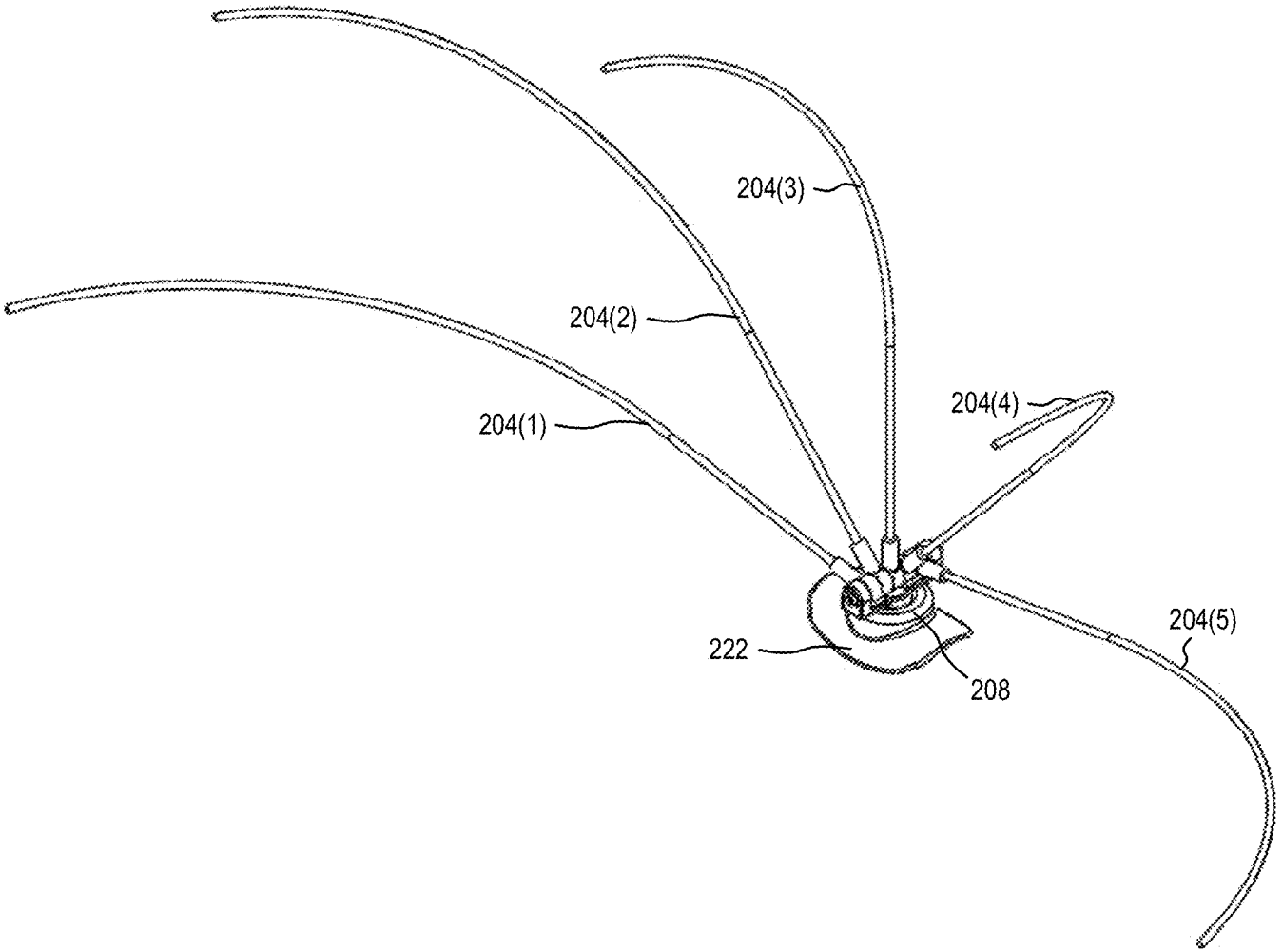
FIG. 4 shows the breastfeeding cover of FIG. 1 with support structure of FIG. 2 discussed above, with the material removed from arms.
Figure 5:
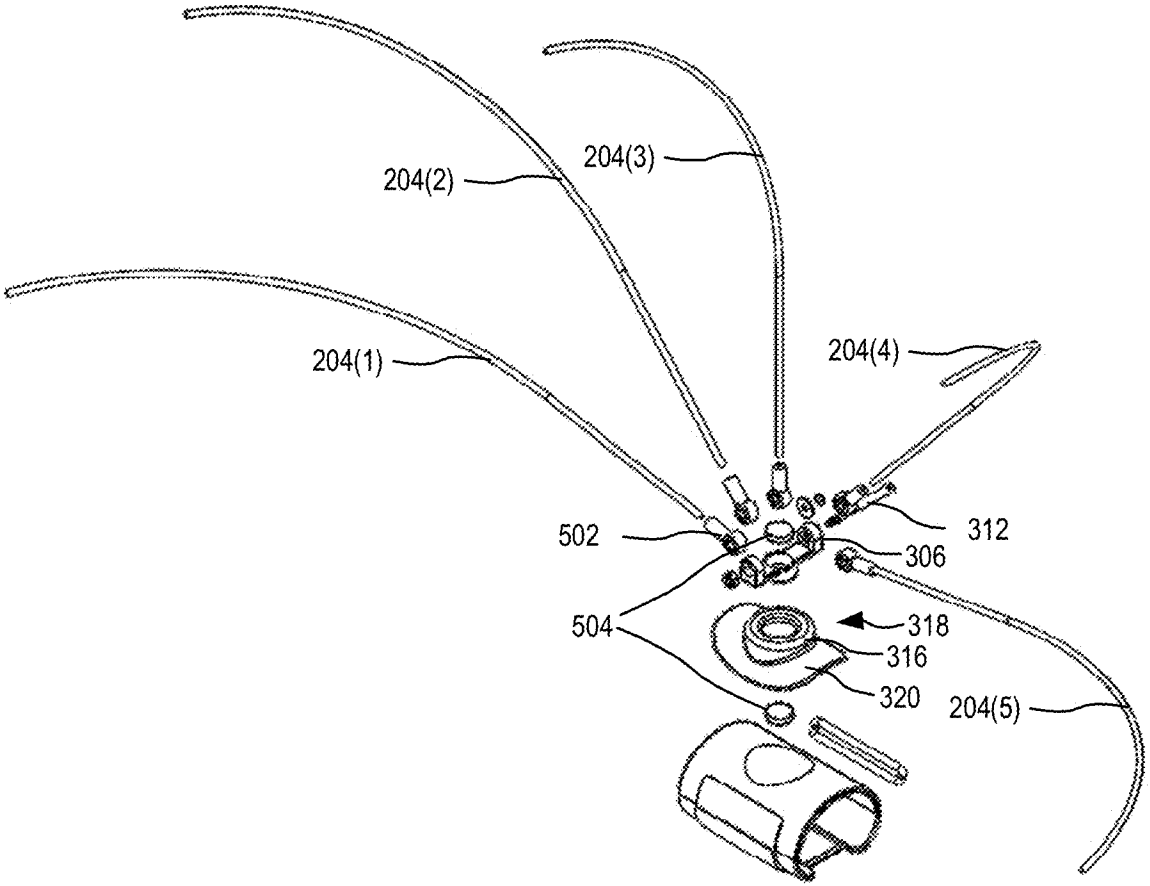
FIG. 5 shows the components of FIG. 4 in exploded view.

FIG. 4 shows the breastfeeding cover 100 with support structure 208 discussed above, with the material 202 removed from arms 204. FIG. 5 shows the components of FIG. 4 in exploded view. In embodiments, arms 204 may terminate at endpiece 502, where arms are mere poles and the endpiece 502 includes the hole that pivot pin 312 passes through to secure arms to rotating piece 306. Moreover, rotating piece 306 may couple to support plate 318 via two-piece fastener 504. In embodiments, two-piece fastener 504 are two magnets, one embedded in support plate 318, and one embedded in rotating part 306, such that rotating part 306 secures to support plate 318 via the magnets 504. The magnet 504 may also allow for attachment of a support having a corresponding magnet on other structures, such as a crib, car seat, bench, play device, stroller, etc.

Figure 6:
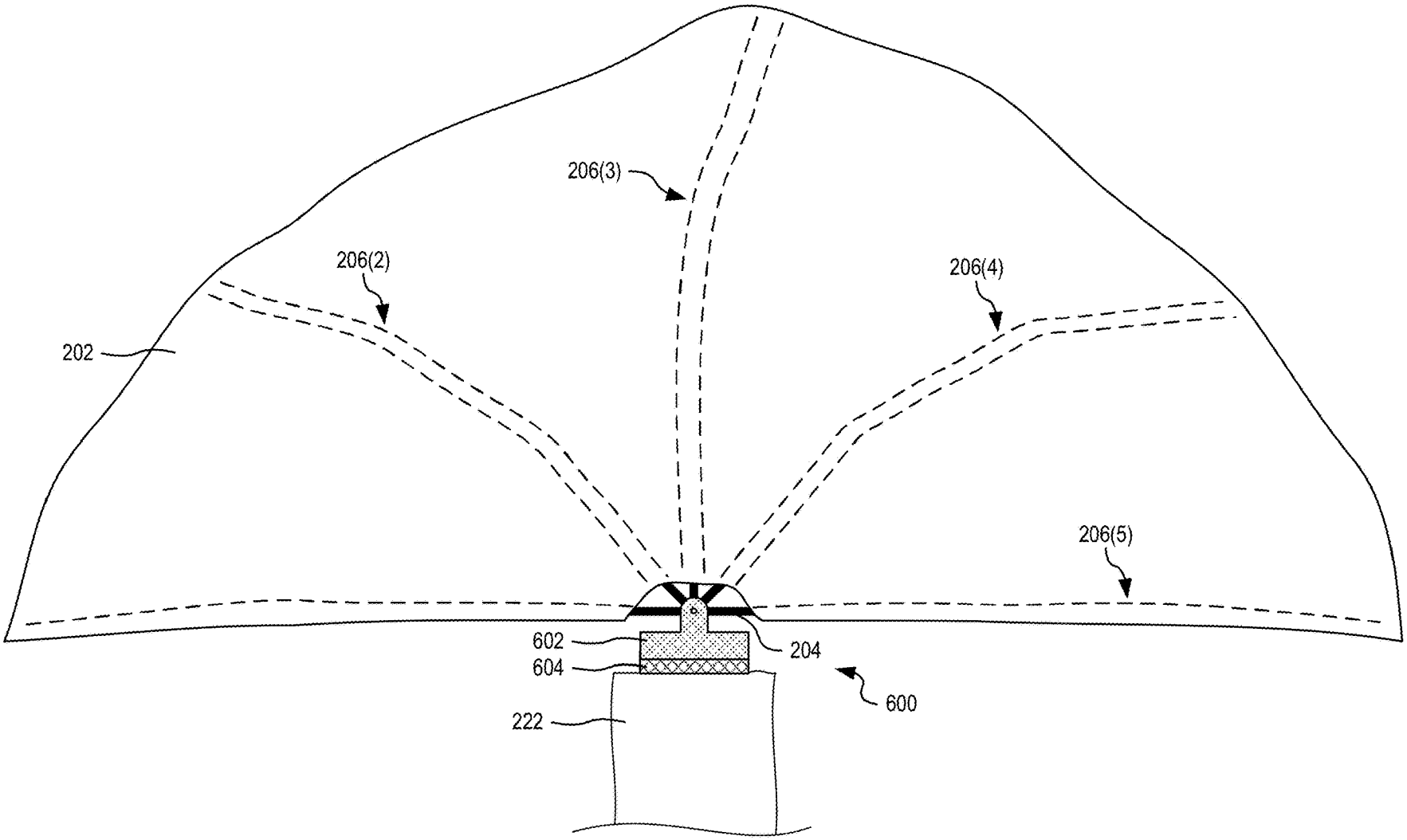
FIG. 6 shows another support structure, which is another embodiment of adjustable base of FIG. 1 useable in the breastfeeding cover.
Figure 7:
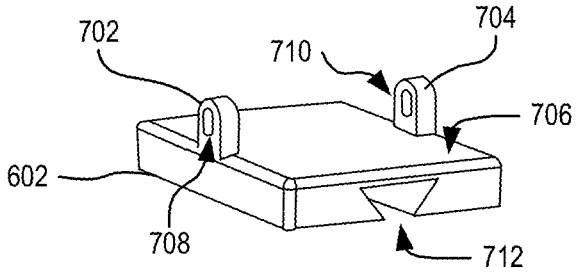
FIG. 7 shows first plate of FIG. 6 in further example detail.

FIG. 6 shows another support structure 600, which is another embodiment of adjustable base 104 useable in the breastfeeding cover 100. FIG. 7 shows plate 602 in further example detail. Plate 602 has two opposed lugs 702 and 704, formed orthogonally on a first side 706 of plate 602. Lug 702 forms a first aperture 708 and lug 704 forms a second aperture 710 that is aligned with first aperture 308. A first coupling structure 712 is formed on a second side of plate 602, opposite first side 706. In the example of FIG. 7, first coupling structure 712 is a dovetailed groove; however, first coupling structure 712 may take other forms without departing from the scope hereof, including those that are rotatable with respect to support plate 604 to allow for rotation to provide the desired coverage regardless of the position the wearer's arm/wrist is in. Adjustable base 600 includes a plate 604 that is fixedly attached to a releasable mounting mechanism 222 and that releasably couples with plate 602 of foldable screen 102. In one embodiment, releasable mounting mechanism 222 is an elasticated (e.g., Lycra® and/or elastic) cuff with a Velcro® (hook-and-loop) closure that is sized to comfortably attach to forearm 154 such that it does not easily move. However, releasable mounting mechanism 222 may take other forms for attaching to other objects as needed. See FIGS. 18 and 19 for example.

Figure 8:
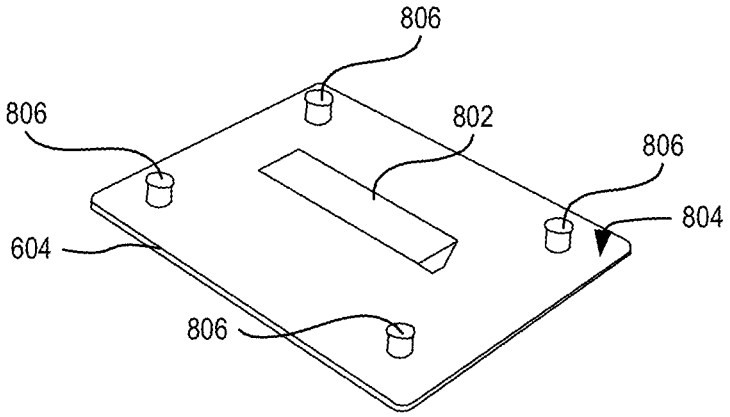
FIG. 8 shows second plate of adjustable base of FIGS. 6 and 7 in further example detail.

FIG. 8 shows plate 604 of adjustable base 600 of FIGS. 6 and 7 in further example detail. Plate 604 includes a second coupling structure 802, formed on a side 804 of plate 604, that is sized and shaped to removably couple with first coupling structure 712 of plate 602. Second coupling structure 802 is shown as a dovetail tongue. However, it should be appreciated that the second coupling structure 802 may be a dovetail groove, and the first coupling structure 712 may be the dovetail tongue; or that the coupling structures 712, 802 may take other forms including those that are rotational to one another. Plate 604 may also include one or more third coupling structures 806 formed on side 804 of plate 604 that facilitate attachment of plate 604 to a releasable mounting mechanism 222 that attaches adjustable base 600 to an object, such as forearm 154 of mother 150.

Figure 9:
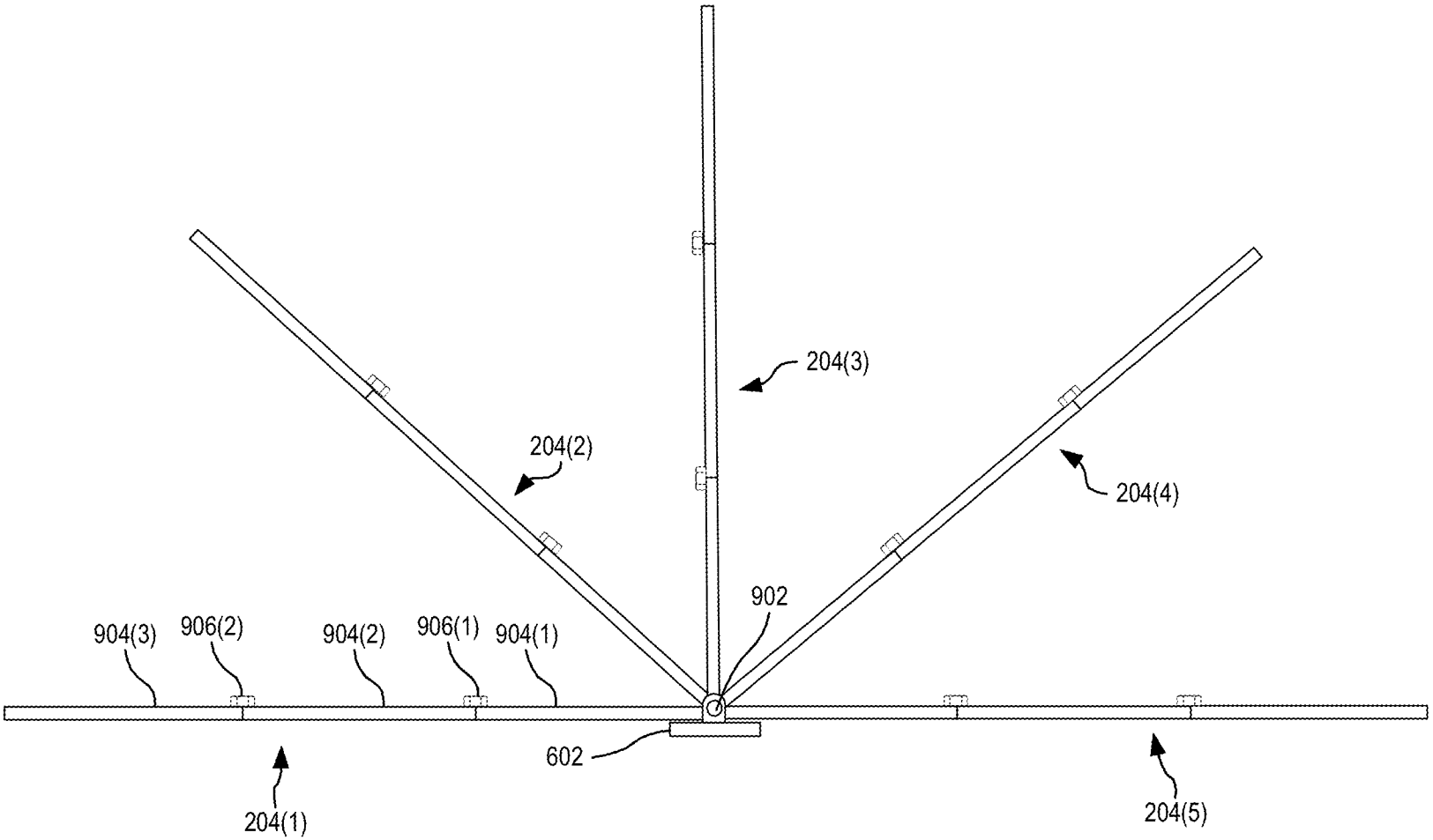
FIG. 9 shows foldable screen useable with the breastfeeding covers herein with five radial arms pivotably coupled with plate by a pivot pin (e.g., bolt) prior to fitting of material.

FIG. 9 shows foldable screen 102 of FIGS. 6-8 with five radial arms 204(1)-(5) pivotably coupled with plate 602 by a pivot pin 902 (e.g., bolt) prior to fitting of material 202. FIG. 9 also shows the concept that each radial arm 204 may be segmented to provide additional flexibility in the size/shape of the breastfeeding cover when the arms are extended. This segmented embodiment may be utilized in FIGS. 1-5 (which are shown with non-segmented radial arms) without departing from the scope hereof. Each radial arm 204 is formed of three articulated segments 904(1)-(3), where articulated segments 904(1) and 904(2) are coupled together by a pivot pin 906(1) and articulated segments 904(2) and 504(3) are coupled together by a pivot pin 906(2). Pivot pins 906(1) and 906(2) provide articulation in a plane substantially orthogonal to a plane of rotation of radial arms 204(1)-(5) about pivot pin 902. In certain embodiments, pivot pin 902 is omitted and radial arms 204 include a molding that snaps together to form the articulated connection with plate 208. Similarly, pivot pins 906 may be omitted and segments 904 include structure that snaps together to form the articulates joints between segments 904. In certain embodiments, each radial arm is formed as a single segment (e.g., omitting pivot pins 906 and the corresponding joints such as shown in embodiments of FIGS. 1-5), where the radial arm is flexible or non-flexible. More or fewer radial arms 204 may be used without departing from the scope hereof. For example, in certain embodiments, foldable screen 102 may have three positionable radial arms, each formed of a single flexible or rigid segment.

Figure 10:
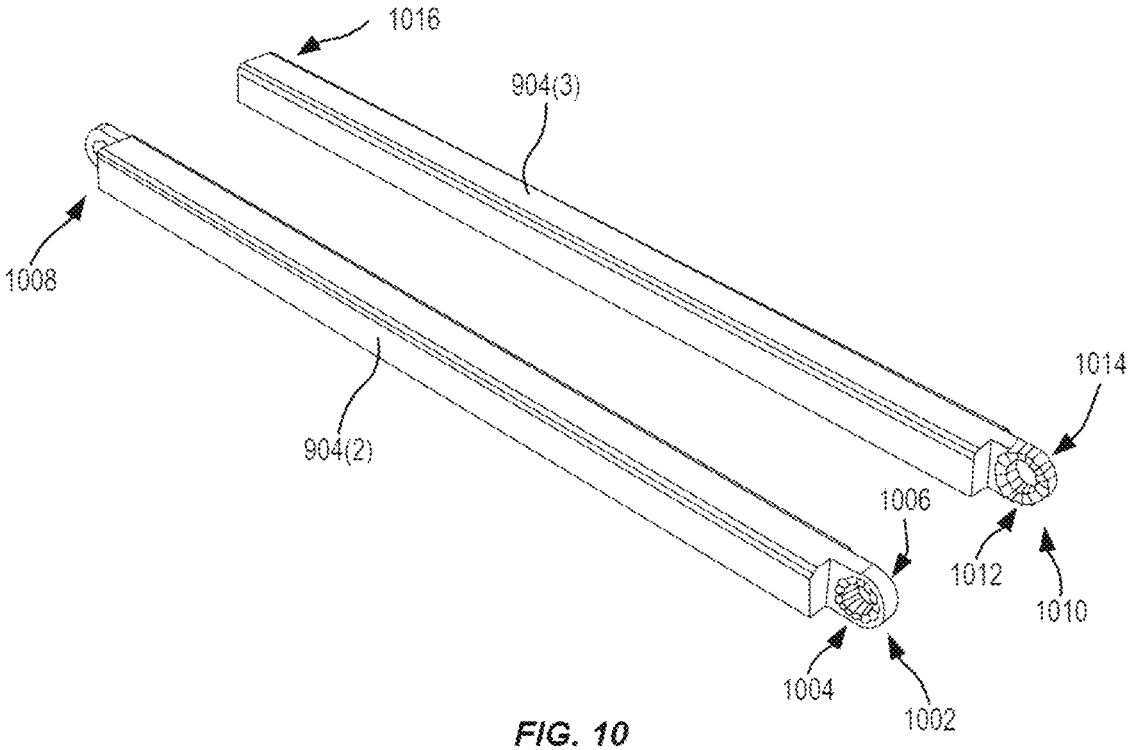
FIGS. 10-12 show segments of radial arm in further example detail.
Figure 11:
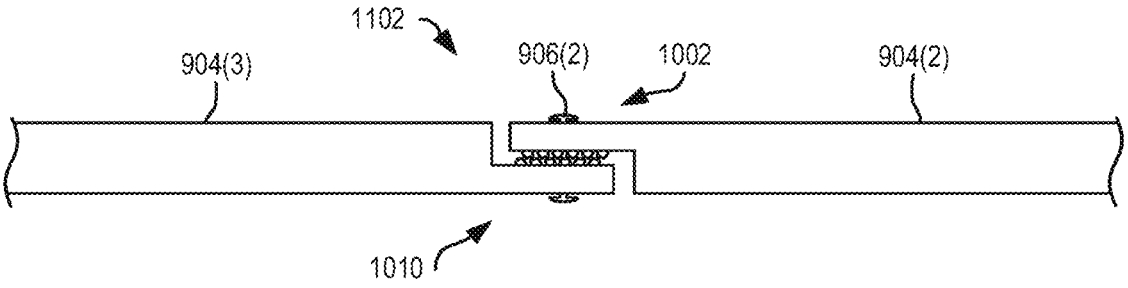
Figure 12:
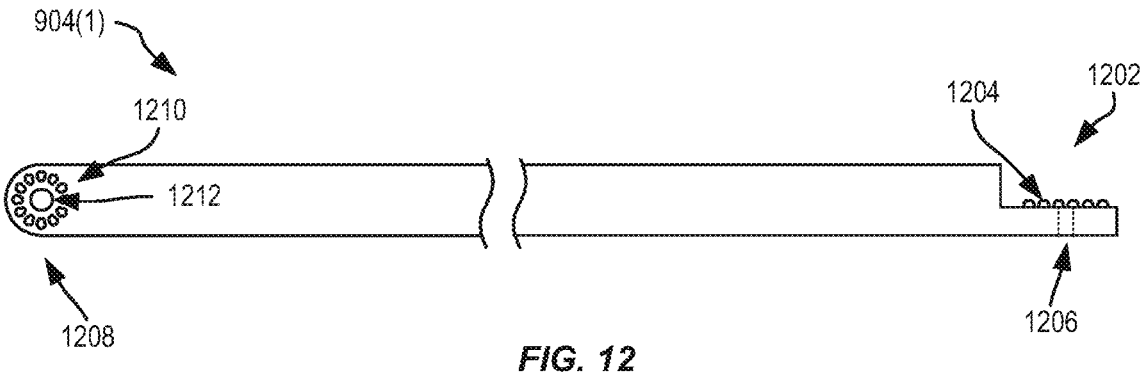

FIGS. 10-12 show segments 904 of radial arm 204 in further example detail. FIG. 10 shows segments 904(2) and 904(3) of radial arm 204(1) in further example detail. FIG. 11 shows segments 904(2) and 904(3) of FIG. 10 connected by pivot pin 906(2). FIG. 12 shows segment 904(1) of radial arm 204(1) in further example detail. FIGS. 10-12 are best viewed together with the following description.

Segments 904(1)-(3) are plastic rods formed with a substantially square cross section. However, segments 804 may have other cross sections and/or be formed of other materials, such as aluminum, carbon fiber, etc., without departing from the scope hereof. For example, segments 804 may be formed by one or more of an injection molding process, a 3D printing process, a metal stamping process, and so on. A first end 1002 of segment 904(2) has an offset with teeth 1004 formed around an aperture 1006. A second end 1008, opposite first end 1002, is similarly formed and in alignment with first end 1002. A first end 1010 of segment 904(3) is formed similar to first end 1002 of segment 904(2) and includes an offset with teeth 1012 formed around an aperture 1014. A second end 1016 of segment 904(3) is unformed but may be rounded in certain embodiments. Segments 904 may have other joint structures and/or indexing methods without departing from the scope hereof.

As shown in FIG. 11, pivot pin 906(2) movably couples first end 1002 of segment 904(2) and first end 1010 of segment 904(3) to form an indexed articulated joint 1102. Segments 904(2) and 904(3) may pivot, relative to one another, around pivot pin 906(2) and teeth 1004 and 1012 engage to provide increased resistance to movement from indexed angles. For example, where a number of teeth 1004 is twenty-four, and a corresponding number of teeth 1012 is twenty-four, assuming they are equally spaced around apertures 1006 and 1014, respectively, segments 904(2) and 904(3) are positionable in indexed angles of fifteen-degrees; where a number of teeth 1004 is twelve, and a corresponding number of teeth 1012 is twelve, assuming they are equally spaced around apertures 1006 and 1014, respectively, segments 904(2) and 904(3) are positionable in indexed angles of thirty-degrees. However, other indexing angles may be used without departing from the scope hereof. Further, teeth 1004 and 1012 provide a resistance to rotation of segments 904(2) and 904(3) relative to one another, thereby allowing foldable screen 102 to maintain its set position.

Segment 904(1) has a first end 1202 that is formed similarly to first end 1002 of segment 904(2) and includes teeth 1204 formed around an aperture 1206. First end 1202 is movably coupled with second end 1008 of segment 904(2) by pivot pin 906(1). A second end 1208 of segment 904(1) is formed with teeth 1010 on opposites sides of segment 904(1) and around an aperture 1212 through segment 904(1) that is perpendicular to a direction of aperture 1206. In certain embodiments, teeth 1210 may be formed in offsets. In certain embodiments, other methods may be used to provide friction to movement of radial arms 204 with respect to each other and with respect to adjustable base 104.

Figure 13:
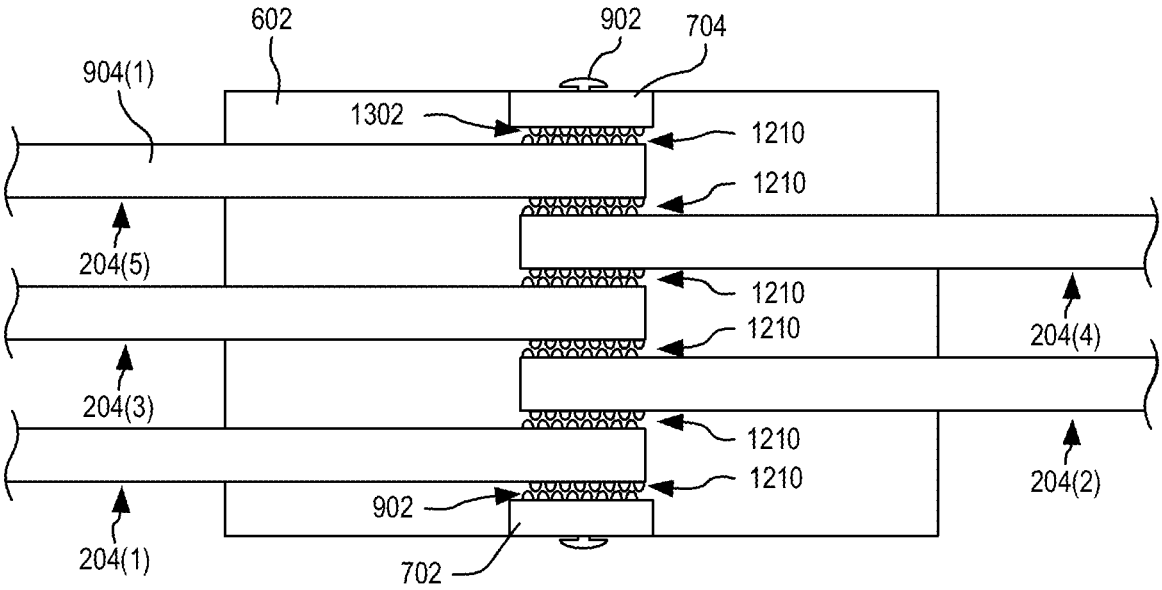
FIG. 13 is a top view showing articulated coupling of radial arms with the plate of FIG. 6 in further example detail.

FIG. 13 is a top view showing articulated coupling of radial arms 204 with plate 602 of FIG. 6 in further example detail. A second end 1208 of each segment 904(1) is positioned between lugs 702 and 704 of plate 602 and pivot pin 902 passes through aperture 1212 of each segment 904(1). Lugs 702 and 704 may also have teeth 1302 that interact with teeth 1210 of adjacent segment 904(1) as shown. It should be appreciated that this embodiment may also apply to lugs 302, 304 of FIG. 3 where lugs 302 and 304 also have teeth 1302 that interact with teeth 1210 of the adjacent segment. Accordingly, segments 904(1) are positionable, relative to plate 602 (or rotating part 208), in indexed angles (e.g., of fifteen-degrees when the number of teeth is twenty-four). Further, teeth 1210 provide a resistance to rotation of segments 904(1) relative to plate 602 (or rotating part 208), thereby allowing foldable screen 102 to maintain its set position.

Figure 14:
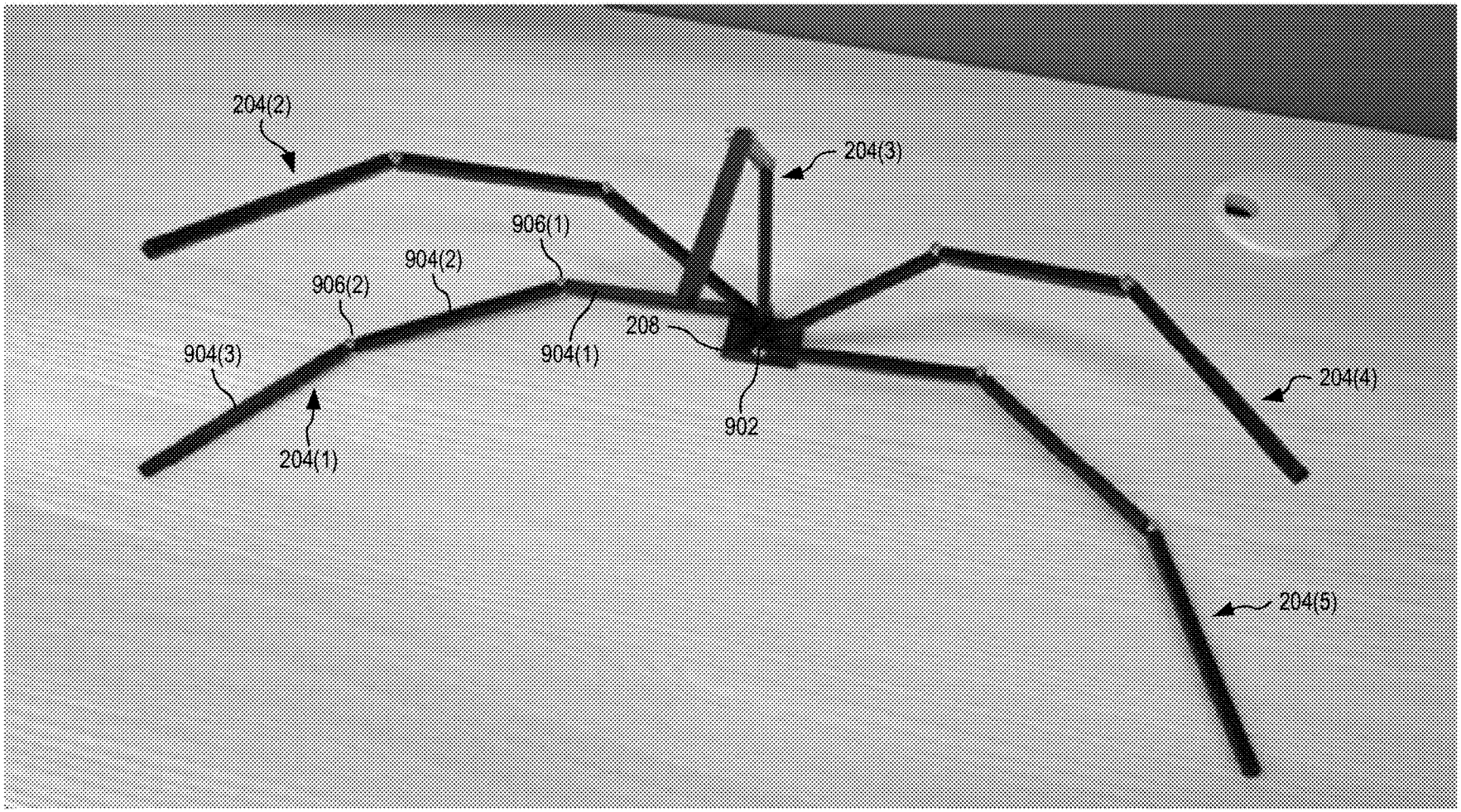
FIG. 14 is a perspective view showing one example position of radial arms and segments of foldable screen of FIGS. 1, 6, and 9, prior to fitting of material.

FIG. 14 is a perspective view showing one example position of radial arms 204(1)-(5) and segments 904 of foldable screen 102 of FIGS. 1, 6, and 9, prior to fitting of material 202. As shown, since pivot pins 906 are oriented perpendicular to pivot pin 902, segments 904 may be positioned to provide foldable screen 102 with a three-dimensional shape.

Figure 15:
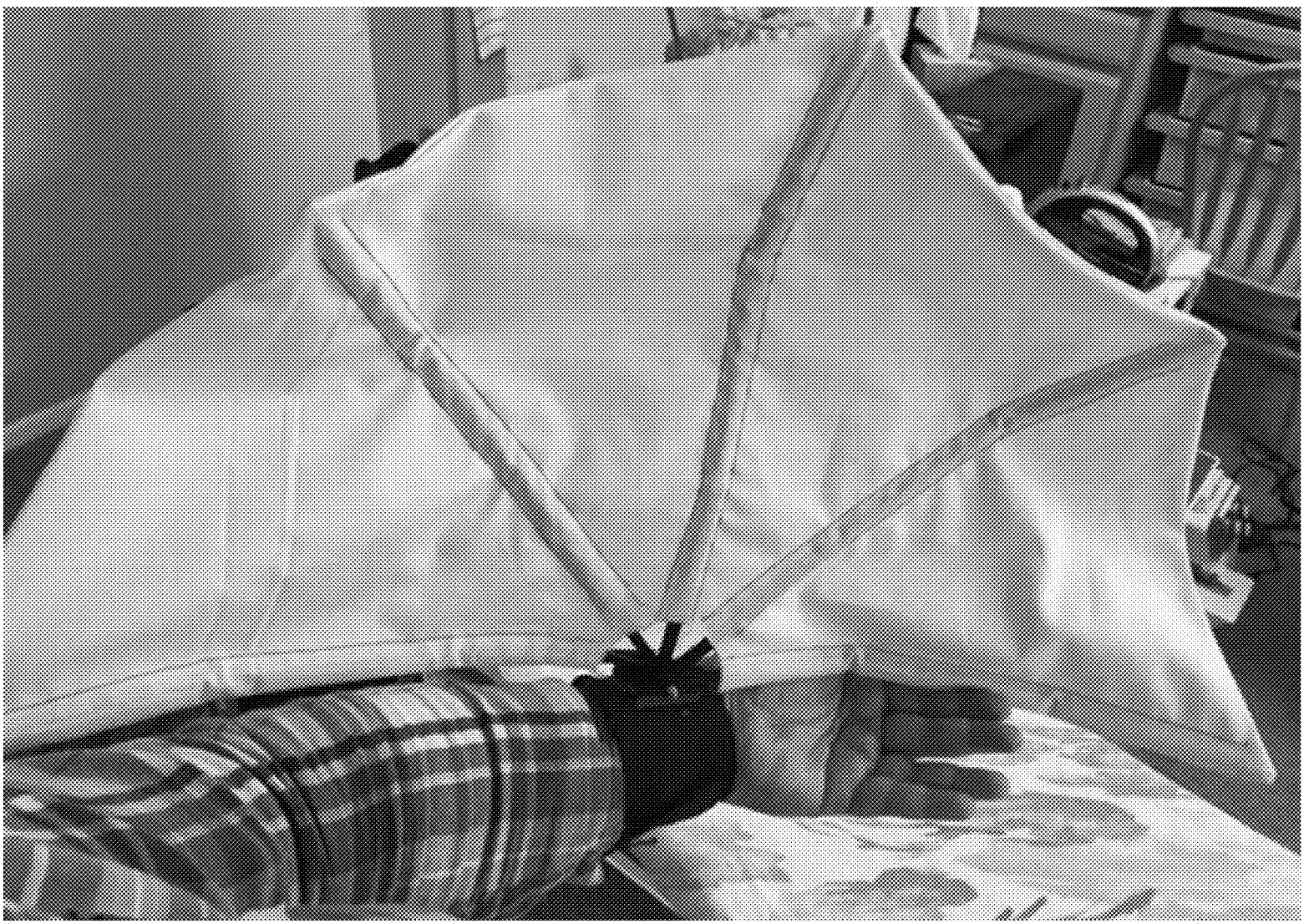
FIG. 15 is a perspective view showing breastfeeding screen attached to a person's wrist with radial arms positioned to form material into a three-dimensional shape.
Figure 16:
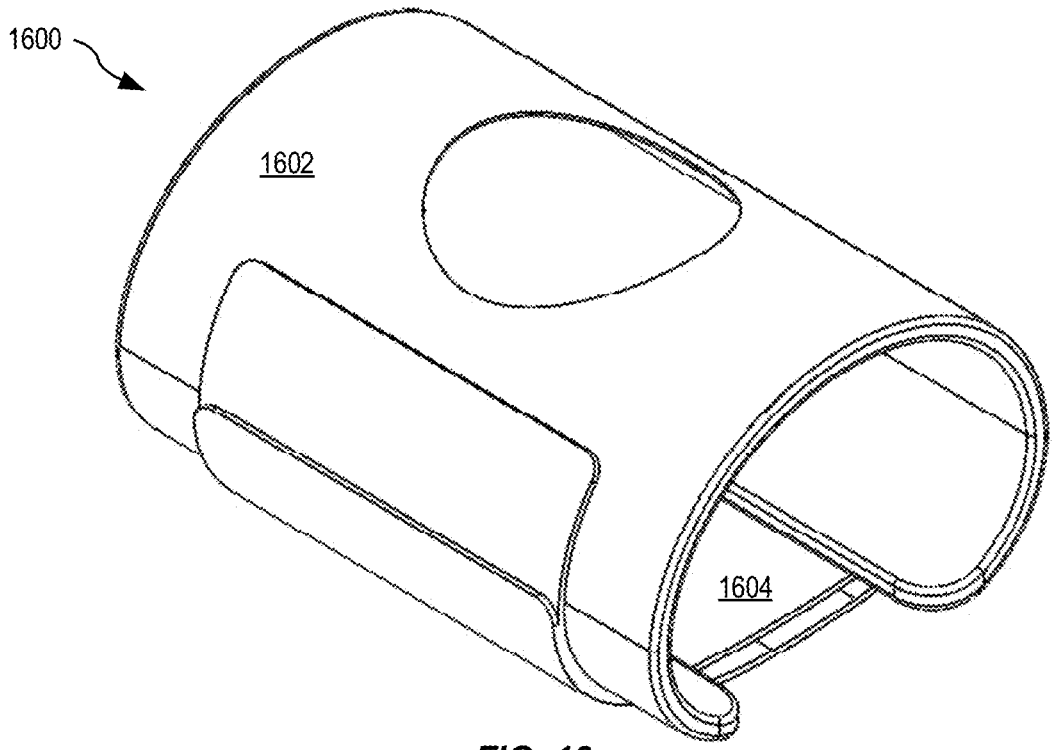
FIGS. 16-17 show an example wristband (also referred to as a "cuff"), which is an embodiment of a releasable mounting mechanism.
Figure 17:
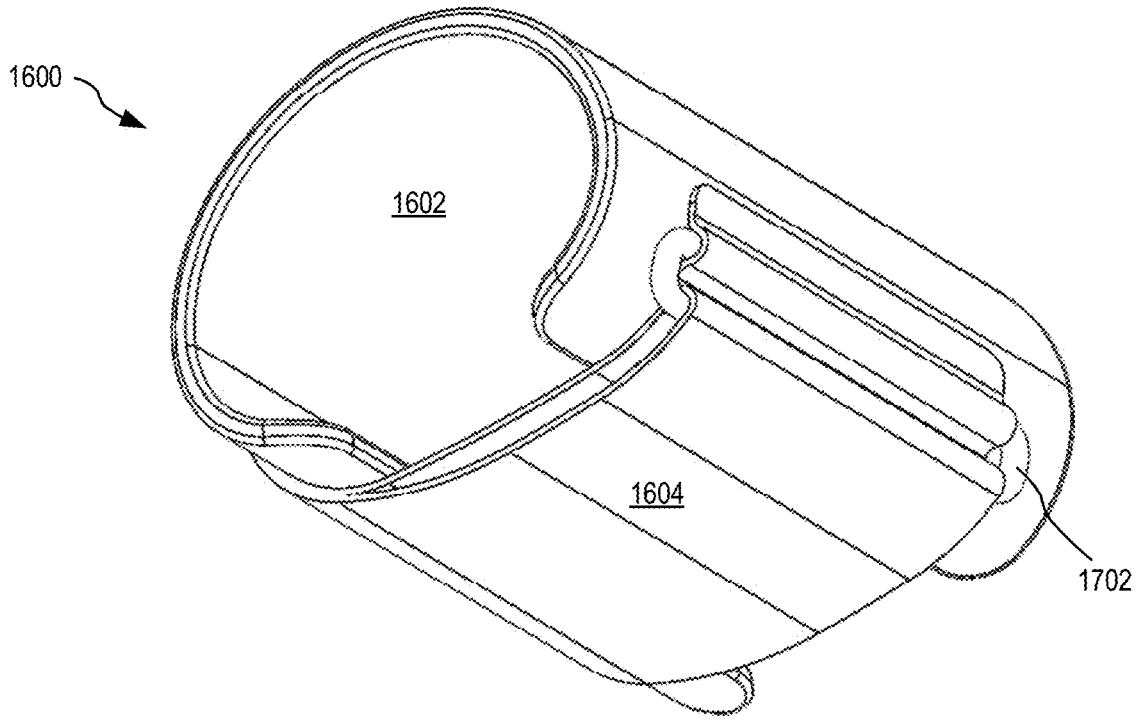

FIG. 15 is a perspective view showing breastfeeding screen 100 attached to a person's wrist with radial arms 204 positioned to form material 202 into a three-dimensional shape. FIGS. 16-17 show an example wristband 1600 (also referred to as a "cuff"), which is an embodiment of releasable mounting mechanism 222. Wristband 1600 includes a top portion 1602 that is of a first material, and a securing portion 1604 that is of a second material. First material and second material may be the same or different. First material and second material may be an elasticated (e.g., Lycra® and/or elastic) cuff with a Velcro® (hook-and-loop) closure that is sized to comfortably attach to forearm 154 such that it does not easily move, or a neoprene material. In an embodiment, first material is of greater thickness than second material. For example, first material may be a neoprene material and second material may be a Velcro® (hook-and-loop) material. Securing portion 1604 may interact with bracket 1702 to provide adjustability of the tightness of wristband 1600.

Top portion 1602 may define an aperture 1606. The second coupling structure 316 discussed above may extend through aperture 1606, and the support plate 320 may position between the top portion 1602 and the arm/wrist when in use. This allows the top portion 1602 to apply a force onto the support plate 320 when the securing portion 1604 is tightened to reduce movement of the breastfeeding cover 100 when in use. The aperture 1606 is shown sized and shaped to correspond to second coupling structure 316, but may be sized and shaped in different manners, such as to correspond to second coupling structure 802 discussed above.

Figure 18:
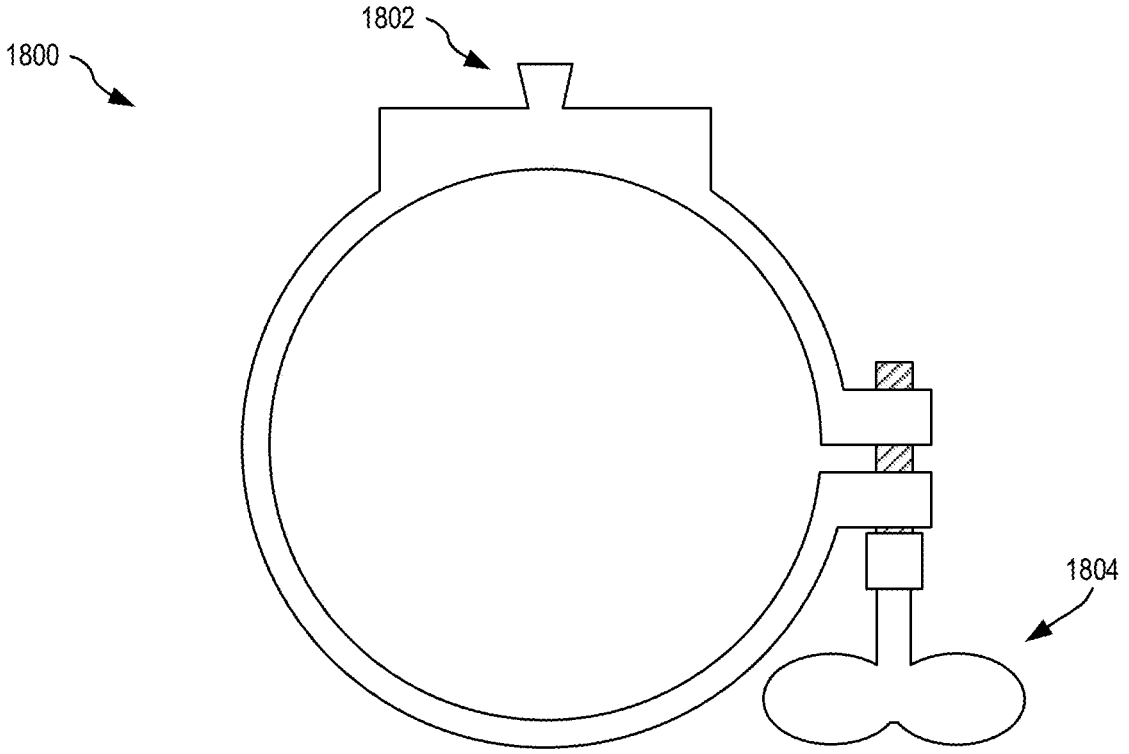
FIG. 18 shows one example clamp for mounting the breastfeeding screen of FIG. 1 to a baby carriage and/or a stroller, in embodiments.

FIG. 18 shows one example clamp 1800 for mounting the breastfeeding screen 100 to a baby carriage and/or a stroller, in embodiments. Clamp 1800 is substantially circular and sized to attach to a frame of the baby carriage or the stroller, or a handle of a car seat. Clamp 1800 includes a thumb screw for tightening clamp to the structure of the baby carriage or the stroller. Although shown as being circular, clamp 1800 may be formed of other shapes without departing from the scope hereof. Clamp 1800 includes a fixture 1802 that removably couples with first coupling structure 712 of plate 602 of FIG. 6. Fixture 1802 may additionally or alternatively include a magnet, such as a magnet that corresponds to magnet 504 of two-piece fastener 504.

Figure 19:
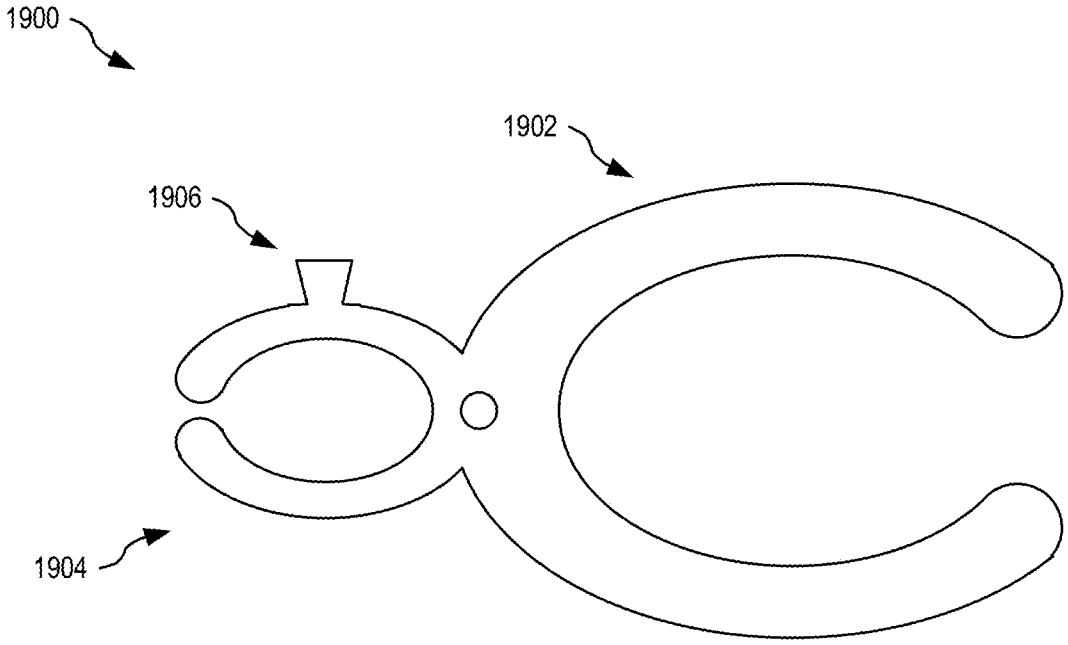
FIG. 19 shows one example clamp for removably mounting the breastfeeding screen of FIG. 1 to other objects, in embodiments.

FIG. 19 shows one example clamp 1900 for removably mounting the breastfeeding screen of FIG. 1 to other objects, in embodiments. Clamp 1900 is formed with handles 1902 and jaws 1904 that open when handles 1902 are squeezed together (e.g., against a return spring, not shown) to allow clamp 1900 to attach to a frame of the baby carriage, a frame of the stroller, a baby carrier, a car seat, a table edge, or other such supportive objects. Clamp 1900 includes a fixture 1906 that removably couples with first coupling structure 712 of plate 602 of FIG. 6. As appreciated, other types of clamp may be used to attach to certain specifically shaped objects or structures. Fixture 1906 may additionally or alternatively include a magnet, such as a magnet that corresponds to magnet 504 of two-piece fastener 504.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A breastfeeding screen, comprising:

a support structure comprising:

a first support structure component, and a second support structure component having a base and a raised part extending from the base, the first support structure component rotatably coupled to the second support structure component at the raised part; and a foldable screen having:

at least three radial arms, each radial arm having a first aperture formed at a first end, each of the at least three radial arms being formed of at least two segments coupled together by respective arm pivot pin to form a respective articulation at the location of the arm pivot pin, at least outer two radial arms of the at least three radial arms being indexed by opposing additional teeth formed around an aperture for receiving an arm pivot pin, wherein the additional teeth allow articulation of at least the outer two radial arms around the arm pivot pin to predefined angles defined by the opposing teeth, two orthogonal lugs secured to the first support structure component and having aligned second apertures, a first pivot pin passing between the aligned second apertures and through each of the first apertures of the at least three radial arms to allow the at least three radial arms to rotate around the first pivot pin, and a material coupled to the at least three radial arms that, when the at least three radial arms rotate bout the first pivot pin, spans between the at least three radial arms; and a releasable mounting mechanism being fixedly attached to the second support structure component adapted to attach the breastfeeding screen to an object.

2. The breastfeeding screen of claim 1, the first support structure component having the two orthogonal lugs on a first side of the first support structure component and a first coupling structure extending from a second side of the first support structure component;

the second support structure component having a second coupling structure, formed on a first side of the second part and that is sized and shaped to removably couple with the first coupling structure.

3. The breastfeeding screen of claim 2, the first part being rotatable with respect to the second part.

4. The breastfeeding screen of claim 2, the first part and the second part coupled together via a magnet.

5. The breastfeeding screen of claim 1, each of the at least three radial arms being formed of a single segment.

6. The breastfeeding screen of claim 5, the single segment being flexible.

7. The breastfeeding screen of claim 1, the releasable mounting mechanism being a cuff formed of an elasticated band sized to fit around a person's arm.

8. The breastfeeding screen of claim 7, the cuff defining an aperture, wherein the support structure extends through the aperture.

9. The breastfeeding screen of claim 8, the support structure positioned between the cuff and a user's wrist when the breastfeeding screen is in use.

10. The breastfeeding screen of claim 7, the cuff further comprising a hook-and-loop closure.

11. The breastfeeding screen of claim 7, the cuff being sewn to a second coupling structure that is sized and shaped to removably couple with the first coupling structure.

12. The breastfeeding screen of claim 1, the releasable mounting mechanism being a clamp sized and shaped to attach to one or both of a stroller, and a car seat.

13. The breastfeeding screen of claim 1, the material having a semi-spherical shape forming at least three pockets, each of the three pockets receiving a different one of the three radial arms.

14. The breastfeeding screen of claim 1, the base being curved to fit around a wrist or forearm for a user.

15. The breastfeeding screen of claim 1, the first support structure component removably secured to the second support structure component.

16. The breastfeeding screen of claim 15, the first support structure component removably secured to the second support structure component via a magnet.

17. The breastfeeding screen of claim 15, the first support structure component removably secured to the second support structure component via a clip structure.

* * * * *